US011753920B1

(12) United States Patent
Witten

(10) Patent No.: US 11,753,920 B1
(45) Date of Patent: Sep. 12, 2023

(54) PARALLEL GAS SEPARATOR, AND SUBMERSIBLE PUMP ASSEMBLY AND METHOD

(71) Applicant: Mingo Manufacturing Incorporated, Owasso, OK (US)

(72) Inventor: Raymond L. Witten, Owasso, OK (US)

(73) Assignee: MINGO MANUFACTURING INCORPORATED, Owasso, OK (US)

( * ) Notice: Subject to any disclaimer, the term of this patent is extended or adjusted under 35 U.S.C. 154(b) by 26 days.

(21) Appl. No.: 17/394,141

(22) Filed: Aug. 4, 2021

(51) Int. Cl.
*E21B 43/38* (2006.01)
*E21B 43/12* (2006.01)

(52) U.S. Cl.
CPC ..... *E21B 43/38* (2013.01); *E21B 43/128* (2013.01)

(58) Field of Classification Search
CPC ..... E21B 43/38; E21B 43/35; E21B 43/14
See application file for complete search history.

(56) References Cited

U.S. PATENT DOCUMENTS 1,655,817 A * 1/1928 Marsh ..... E21B 43/38 166/105.5
3,887,342 A * 6/1975 Bunnelle ..... B01D 19/0057 417/313
4,088,459 A * 5/1978 Tuzson ..... E21B 43/38 96/217
4,481,020 A * 11/1984 Lee ..... B01D 19/0052 96/214
4,913,630 A * 4/1990 Cotherman ..... E21B 43/128 417/313
5,207,810 A * 5/1993 Sheth ..... B04B 5/12 166/105.5
5,404,943 A * 4/1995 Strawn ..... F04D 13/10 166/54.1
5,525,146 A * 6/1996 Straub ..... E21B 43/121 96/217
6,066,193 A * 5/2000 Lee ..... E21B 43/38 96/216
6,155,345 A * 12/2000 Lee ..... E21B 43/121 96/217
6,228,146 B1 * 5/2001 Kuespert ..... E21B 43/38 96/9
2010/0258306 A1 * 10/2010 Camilleri ..... E21B 43/128 166/265
2011/0146976 A1 * 6/2011 Hackworth ..... E21B 43/38 210/512.2
2016/0201444 A1 * 7/2016 Hardee ..... E21B 43/128 166/265

FOREIGN PATENT DOCUMENTS

WO WO-2014152585 A1 * 9/2014 ..... B01D 17/0217

* cited by examiner

*Primary Examiner* — Blake Michener
(74) *Attorney, Agent, or Firm* — Dennis D. Brown; Brown Patent Law, P.L.L.C.

(57) ABSTRACT

A parallel gas separator apparatus and method used in an electric submersible pump (ESP) system includes two or more internal mechanical separation chambers which operate in parallel to significantly increase both the processing capacity of the gas separator and the liquid production rate of the ESP system.

18 Claims, 3 Drawing Sheets

PARALLEL GAS SEPARATOR, AND SUBMERSIBLE PUMP ASSEMBLY AND METHOD

FIELD OF THE INVENTION

The present invention relates to electric submersible pump (ESP) assemblies and ESP methods for recovering well production fluids, and to a high-capacity, parallel gas separator apparatus for use in such ESP assemblies and methods. The high-capacity gas separator apparatus houses multiple, parallel mechanical separation chambers which simultaneously receive separate amounts of fresh production fluid from the well and operate to separate free gas from the fluid. The parallel operation of the multiple mechanical separation chambers within the gas separator apparatus significantly increases the capacity and the liquid production rate of the ESP system.

BACKGROUND OF THE INVENTION

ESP assemblies are used in petroleum wells and other wells to provide artificial lift for delivering liquid products to the surface. The ESP assembly will typically be suspended in the casing of the well on the end of a tubing string such that the assembly is positioned within a subterranean production zone. The ESP assembly will typically comprise a series or string of components which include: a submersible pump; a submersible electric motor which is positioned below and which drives the submersible pump; a "protector" or seal section which is positioned between the motor and the pump and which isolates the motor from the well fluid; an oil reservoir for the motor; and a thrust bearing assembly to support the axial load and to prevent the motor from being damaged by axial thrust forces which are produced by the submersible pump and/or other components of the ESP system during the pumping operation.

The submersible pumps used in oil field operations are multistage centrifugal pumps which comprise a series of impeller elements mounted within the pump housing on an elongate rotating shaft. The submersible pump will also typically comprise (a) a fluid intake which is located below the lowermost impeller element and (b) a fluid discharge which is located at the upper end of the pump. The rotation of the pump shaft is driven by the submersible electric motor.

The multistage submersible pumps used in downhole pumping operations are capable of operating across a broad range of flow rates and depths. Each stage of the submersible pump typically comprises a driven impeller followed by a diffuser which directs the fluid to the next stage of the pump or to the pump discharge. The number of stages used for a given downhole operation will primarily depend upon (a) the amount of flow required and (b) the depth of the well.

In ESP applications in which the fluid produced by the well comprises a liquid and gas mixture having a gas-to-liquid ratio of about 10% by volume or greater, the ESP assembly will typically also include a gas separator which is installed on the intake of the submersible pump between the pump and the seal/protector section. The purpose of the gas separator is to remove all or a sufficient portion of the gas phase from the production fluid prior to delivery to the submersible pump in order to prevent cavitation, gas locking, and cycling, which can significantly reduce the production rate and the run life of the ESP system. Examples of gas separator assemblies and devices commonly used in the industry include (a) mechanical separators such as rotary gas separators and vortex separators and (b) static separators.

Rotary gas separators use centrifugal force to separate the liquid and gas phases of the production fluid. One type of rotary separator assembly currently used in the industry comprises: an elongate housing having a fluid intake at the lower end thereof; an elongate rotating shaft which extends through and is rotatably mounted within the housing and is also driven by the submersible electric motor; a helical inducer which is mounted on the rotating shaft in the lower portion of the housing following the intake section; a guide vane element mounted on the rotating shaft above the inducer; a paddle wheel-type impeller or other centrifugal rotor element mounted on the rotating shaft above the guide vane element; a gas and liquid flow divider on or over the upper end of the centrifugal rotor element; and a non-rotating crossover element mounted above the flow divider.

During operation, the helical inducer, the guide vane element, and the centrifugal rotor of the rotary gas separator assembly are spun by the rotating shaft such that (a) the inducer increases the pressure of the intake fluid and delivers the fluid upwardly through the guide vanes, (b) the guide vanes direct the flow of the production fluid from the inducer upwardly into the centrifugal rotor; (c) the centrifugal rotor spins the production fluid at high speed such that the greater centrifugal force acting on the liquid phase of the production fluid drives the liquid phase radially outward toward the interior wall of the housing, whereas the gas phase concentrates in the central portion of the housing around the rotating shaft; (d) the flow divider directs the separated gas and liquid phases upwardly along separate flow paths; and (e) the crossover element directs the liquid phase into the intake of the submersible pump while directing the separated gas phase into the annulus of the well bore between the exterior of the ESP assembly and the interior wall of the well casing.

Vortex separators currently used in the industry are often similar to rotary separators except that, rather than using a centrifugal rotor, the vortex separator will use an inducing propeller or other element which produces slippage between the gas and liquid phases of the production fluid such that the heavier liquid phase moves radially outward while the gas phase concentrates in the central portion of the housing around the rotating shaft.

Unfortunately, however, the fluid processing capacities of the mechanical gas separators heretofore known in the art have been very limited. By way of example, in large diameter wells, the mechanical separators heretofore used in the art generally have not been capable of producing more than 1000 barrels per day (BPD) of concentrated liquid and generally have not been well suited for use for production rates of more than 500 to 700 BPD. Consequently, in wells capable of much higher production rates, the production capacity of the entire ESP system will typically be limited by the gas separator. Moreover, the production capacity of the ESP system cannot be significantly increased by using two or more of the prior gas separator devices in series.

Consequently, a need exists for an improved ESP system and method, and an improved mechanical gas separator assembly and method for use in ESP systems, which are effective for providing significantly higher fluid processing capacities and liquid production rates.

SUMMARY OF THE INVENTION

The present invention provides an ESP system, and a gas separator apparatus and method therefor, which alleviate the problems and satisfy the needs discussed above. The inventive gas separator apparatus comprises two or more internal mechanical separation chambers which operate in parallel to significantly increase both the processing capacity of the inventive gas separator and the liquid production rate of the ESP system. As compared to a prior art separator having a single mechanical separation chamber, each additional parallel separation chamber used in the inventive separator apparatus increases the processing capacity and the production rate of the inventive separator by an amount which is from 50% to 100% (more typically from 70% to 90%) of the capacity of the single chamber unit.

In one aspect, there is provided an apparatus for use in a submersible pump assembly for separating a gas phase from a well production fluid. The apparatus preferably comprises: (a) an elongate body having a longitudinal axis; (b) a lower mechanical separation chamber in the elongate body, the lower mechanical separation chamber having an intake for receiving a separate amount of the well production fluid and the lower mechanical separation chamber having a rotary or vortex gas separator assembly therein; (c) a higher mechanical separation chamber in the elongate body, the higher mechanical separation chamber having an intake for receiving a separate amount of the well production fluid, the intake of the higher mechanical separation chamber being provided at a higher longitudinal location than the intake of the lower mechanical separation chamber and the higher mechanical separation chamber having a rotary or vortex gas separator assembly therein; (d) the elongate body having an internal concentrated fluid pathway which extends upwardly from the lower mechanical separation chamber to a concentrated fluid discharge at an upper end of the elongate body and is configured to deliver a concentrated fluid product produced by the lower mechanical separation chamber to the concentrated fluid discharge; (e) an elongate rotating shaft which extends longitudinally through the elongate body; (f) the elongate body having a gas phase discharge which is provided at a higher longitudinal location than the intake of the higher mechanical separation chamber; and (g) the elongate body also having an internal gas phase pathway which is different from the internal concentrated fluid pathway, wherein the internal gas phase pathway extends from the lower mechanical separation chamber to the gas phase discharge and is configured to deliver a separated gas phase product produced by the lower mechanical separation chamber to the gas phase discharge.

In another aspect, there is provide an electric submersible pump assembly for a well which preferably comprises: an electric submersible motor; a gas separator apparatus, preferably of the type just described, which is positioned above the electric submersible motor, and a submersible pump positioned above the gas separator apparatus.

In another aspect, there is provided a method of recovering a fluid product from a well. The method preferably comprises the steps of: (a) positioning an electric submersible pump assembly in the well, wherein the electric submersible pump assembly comprises an electric submersible motor, a gas separator apparatus above the electric submersible motor, and a submersible pump above the gas separator apparatus; (b) receiving an amount of a production fluid from the well through an intake of a lower mechanical separation chamber of the gas separator apparatus and separating an amount of a gas phase therefrom in the lower mechanical separation chamber to produce a concentrated product, the lower mechanical separation chamber having a rotary or vortex gas separator assembly therein; (c) delivering the amount of the gas phase separated in step (b) through an internal gas phase pathway in the gas separator apparatus to a gas discharge which is provided in an upper portion of the gas separator apparatus; (d) delivering the concentrated product produced in step (b) through an internal concentrated fluid pathway, different from the internal gas phase pathway, to a concentrated fluid discharge at an upper end of the gas separator apparatus; (e) simultaneously with step (b) receiving an amount of the production fluid from the well through an intake of a higher mechanical separation chamber of the gas separator apparatus and separating an amount of a gas phase therefrom in the higher mechanical separation chamber to produce a concentrated product, the intake of the higher mechanical separation chamber being provided at a higher longitudinal location than the intake of the lower mechanical separation chamber and the higher mechanical separation chamber having a rotary or vortex gas separator assembly therein; (f) delivering the amount of the gas phase separated in step (e) to the gas discharge of the gas separator apparatus, wherein the gas discharge of the gas separator apparatus is provided at a higher longitudinal location than the intake of the higher mechanical separation chamber; and (g) delivering the concentrated product produced in step (e) to the concentrated fluid discharge at the upper end of the gas separator apparatus.

Further aspects, features, and advantages of the present invention will be apparent to those in the art upon examining the accompanying drawings and upon reading the following Detailed Description of the Preferred Embodiments.

DETAILED DESCRIPTION OF THE PREFERRED EMBODIMENTS

Figure 1:
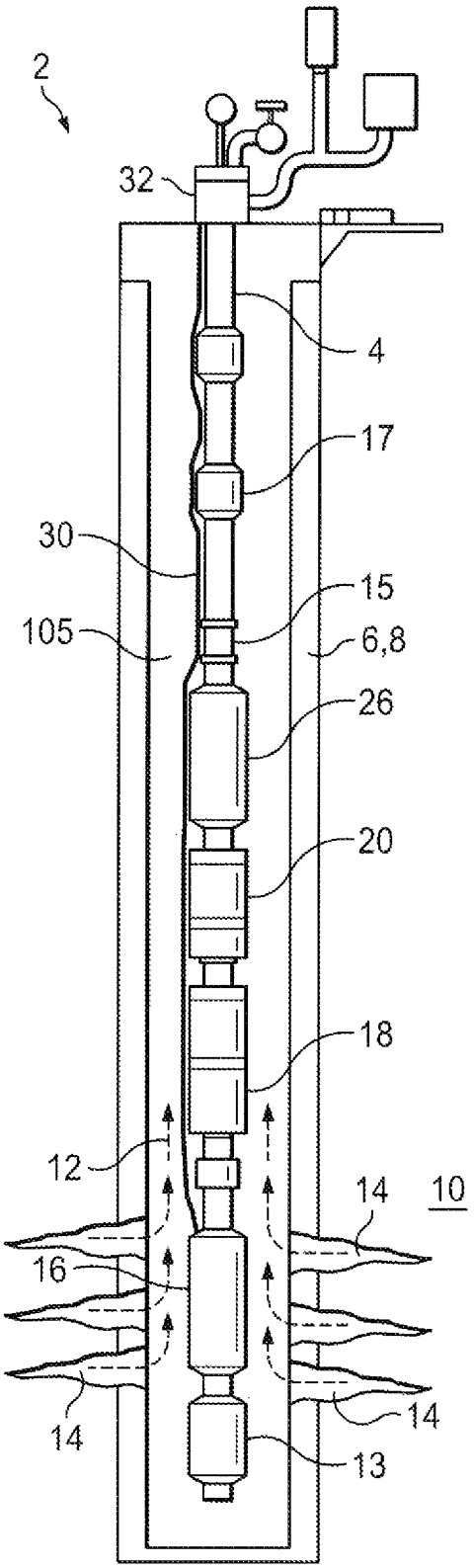
FIG. 1 schematically illustrates an embodiment 2 of the electric submersible pump assembly provided by the present invention.

An embodiment 2 of the electric submersible pump (ESP) assembly provided by the present invention is illustrated in FIG. 1. The inventive ESP assembly 2 is secured on the lower end of a tubing string or other conduit 4 which extends downwardly in the casing 6 of a well 8 such that the ESP assembly 2 is positioned within a producing subterranean formation 10. A well production fluid 12 from the subterranean formation 10 flows into the casing 6 via a set of perforations 14 which are formed through the wall of the casing 6.

The inventive ESP assembly 2 preferably comprises: (1) a submersible electric motor 16 at the lower end of the ESP assembly 2; (2) a seal element (protector) 18 positioned above the motor 16, the seal element 18 having a rotating shaft which extends through the seal element 18 and has a lower end which is coupled with the drive shaft of the motor 16; (3) an inventive parallel gas separator apparatus 20 positioned above the seal element 18, the gas separator apparatus 20 having a rotating shaft 22 which extends through the gas separator apparatus 20 and has a lower end 24 which is coupled with the upper end of the rotating shaft of the seal element 18; (4) a submersible pump 26 positioned above the inventive gas separator apparatus 20, the submersible pump 26 having a rotating pump shaft which rotates a series of centrifugal impeller elements within the pump 26 and has a lower end which is coupled to the upper end 28 of the rotating shaft 22 of the gas separator apparatus 20; and (5) an electrical power cable 30 which extends downhole to the submersible electric motor 16 from a power source at the well head 32.

It will be understood that the inventive ESP assembly 2 can also optionally include additional components and features which are sometimes used in ESP systems. Examples of such additional components and features include, but are not limited to: one or more sensors 13 located below the electric motor 16 or elsewhere for sensing and transmitting downhole temperatures, pressures, or other downhole conditions, readings or events; one or more additional gas separator apparatuses or devices above and/or below the inventive gas separator 20; one or more additional submersible pumps positioned in series with the submersible pump 26; one or more additional motors; or a check valve 15, drain valve 17, or other protective device located above the discharge of the pump 26. It will also be understood that in some cases, the seal element 18 may not be present in the ESP assembly 2.

The inventive ESP assembly 2 and the inventive parallel gas separator 20 can be used in wells wherein the fluid 12 produced by the well 8 has a gas-to-liquid ratio of up to 50% by volume or more.

The submersible electric motor 16 of the inventive ESP assembly 2 can be any type of submersible electric motor 16 suitable for use at the conditions which exist in the well 8. The motor 16 will typically be a squirrel cage, two pole, three phase induction motor. The motor 16 will also preferably include a variable speed drive.

The seal element 18 of the inventive ESP assembly 2 isolates the motor 16 from the well fluid and will typically also include a high capacity thrust bearing to protect the motor 16 from the weight of the system and the axial thrust forces produced by the pump 26 and/or other system components.

The submersible pump 26 of the inventive ESP assembly 2 is a multi-stage centrifugal pump wherein each stage preferably comprises a rotating pump impeller followed by a stationary diffuser. The number of stages used in the pump 26 will depend primarily upon the production flow rate and the amount of lift required.

The inventive gas separator apparatus 20 used in the ESP assembly 2 removes most or all of the free gas from the well production fluid 12 and delivers the resulting concentrated fluid product to the submersible pump 26 for pumping to the surface.

The inventive gas separator apparatus 20 preferably comprises: an elongate body 34 through which the above-mentioned elongate rotating shaft 22 extends, the body 34 having a longitudinal axis 36; a lower mechanical separation chamber 44*a* provided in the elongate body 34; a mid-level mechanical separation chamber 44*b* provided in the elongate body 34 above the lower chamber 44*a*; and a higher mechanical separation chamber 44*c* provided in the elongate body 34 above the mid-level chamber 44*b*. Moreover, each of the mechanical separation chambers 44*a*, 44*b*, and 44*c* preferably has a rotary or vortex gas separator assembly 55*a*, 55*b*, or 55*c* provided therein as will be discussed in more detail below.

The lower mechanical separation chamber 44*a* has one or more, preferably a plurality, of fluid intake openings 40 at the lower end of the chamber 44*a* which are preferably provided in a base sub 38 at the bottom of the elongate body 34. The mid-level mechanical separation chamber 44*b* has one or more fluid intake openings 92 at the lower end of the chamber 44*b* which are preferably provided in a mid-level fluid intake structure 46 which is included in the elongate body 34 above the lower separation chamber 44*a*. The higher mechanical separation chamber 44*c* has one or more fluid intake openings 100 at the lower end of the chamber 44*c* which are preferably provided in an upper fluid intake structure 48 which is included in the elongate body 34 above the mid-level separation chamber 44*b*. Consequently, the mid-level fluid intake 92 of the mid-level mechanical separation chamber 44*a* is provided at a higher longitudinal location than the lower fluid intake 40 of the lower mechanical separation chamber 44*a* and the upper fluid intake 100 of the higher mechanical separation chamber 44*c* is provided at a higher longitudinal location than the mid-level fluid intake 92 of the mid-level mechanical separation chamber 44*b*.

Figure 2:
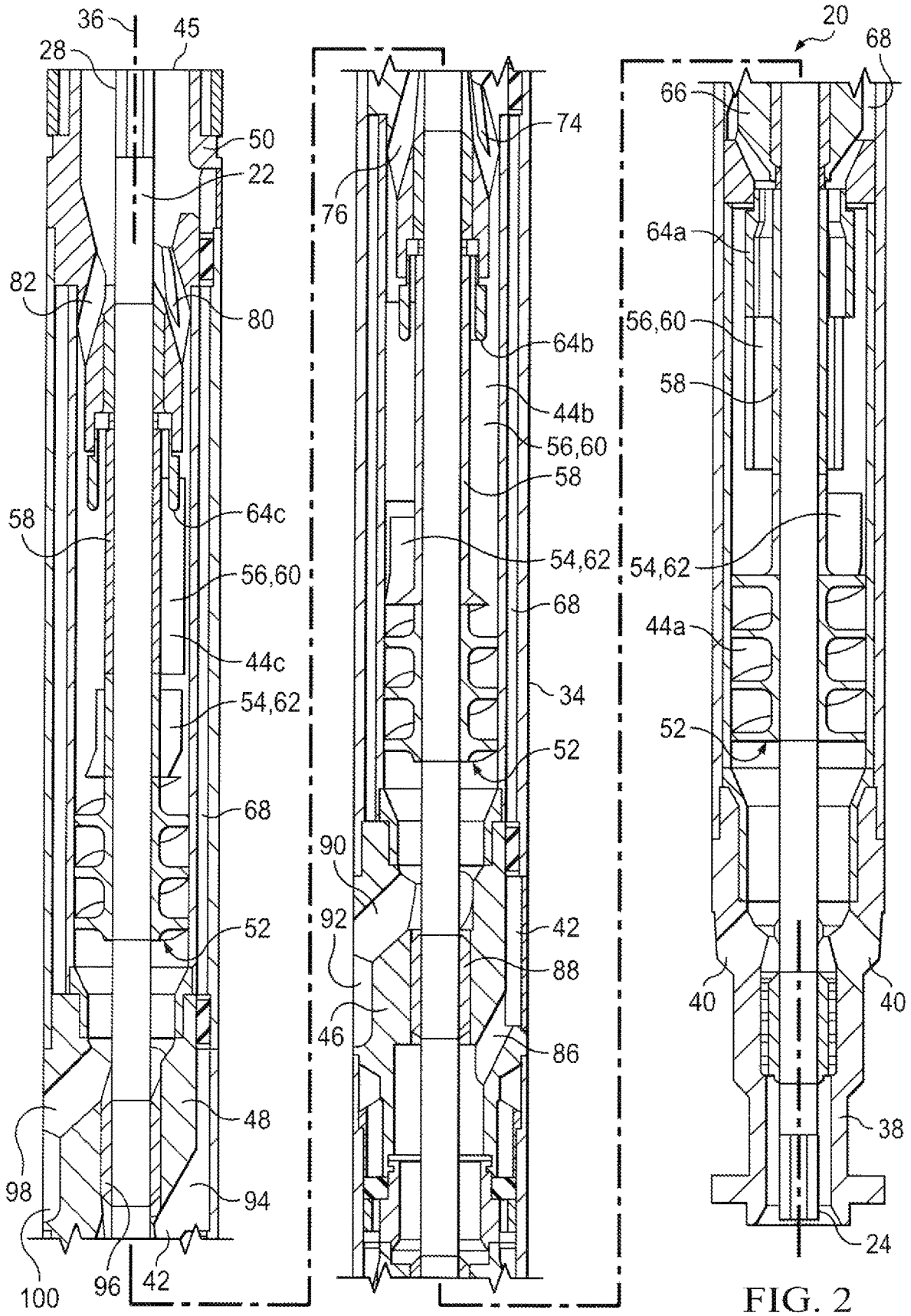
FIG. 2 is a cutaway elevational view of an embodiment 20 of the inventive parallel gas separator apparatus which is provided by the present invention and is used in the electric submersible pump assembly 2.
Figure 3:
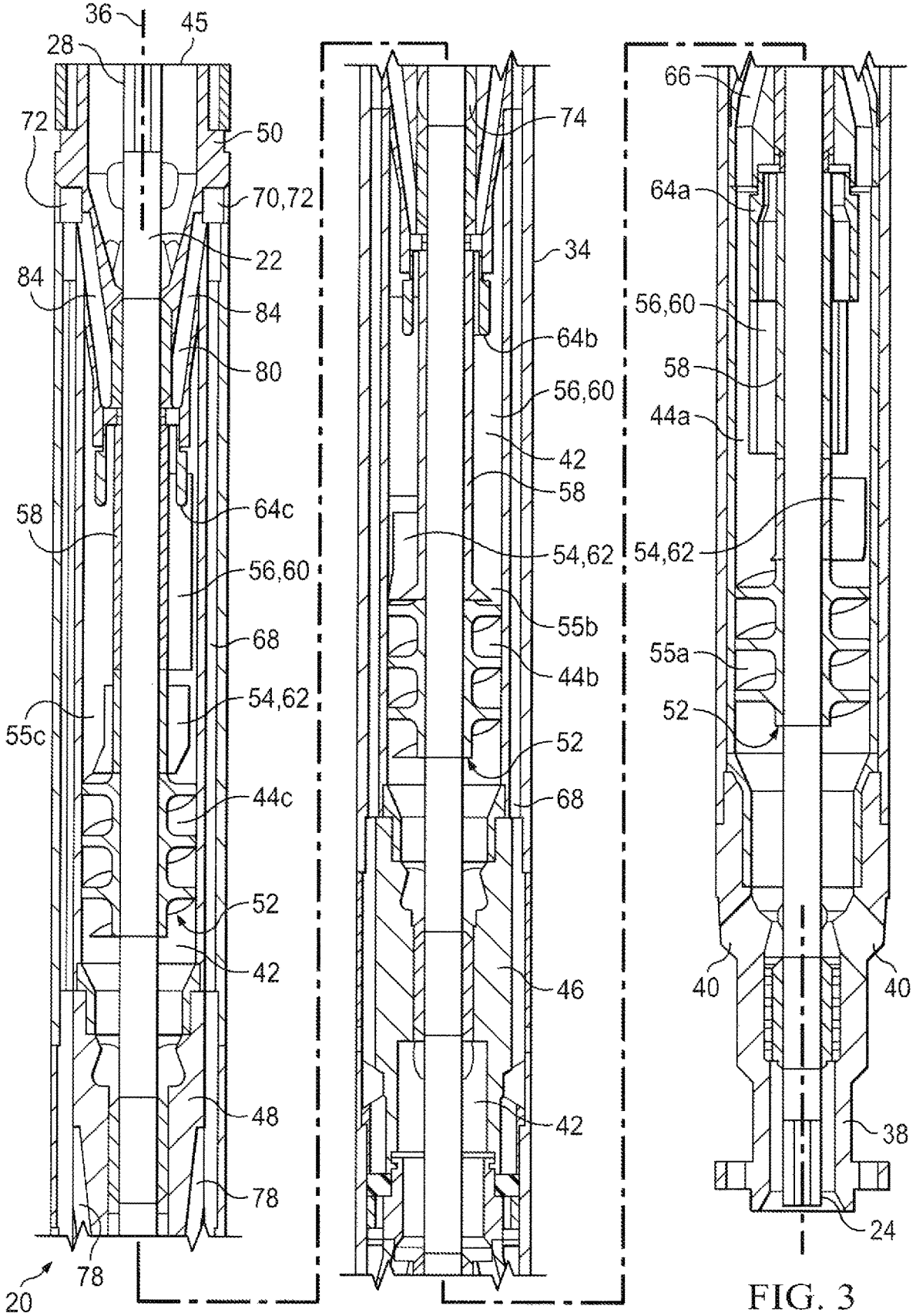
FIG. 3 is another cutaway elevational side view of the inventive parallel gas separator apparatus 20 rotated 90°.

Although the embodiment 20 of the inventive gas separator apparatus 20 illustrated in FIGS. 2 and 3 includes three mechanical separation chambers 44*a*, 44*b*, and 44*c*, it will be understood that the inventive gas separator apparatus 20 can alternatively comprise only two, or more than three, such separation chambers. The number of mechanical separation chambers provided in the inventive gas separator apparatus 20 will preferably be in the range of from 2 to 5. It will also be understood that the rotary or vortex gas separator assemblies 55*a*, 55*b*, and 55*c* used in the mechanical separation chambers 44*a*, 44*b*, and 44*c* can be of the same type or of different types.

The inventive gas separator apparatus 20 preferably also comprises (a) an internal concentrated fluid pathway 42 which is provided in elongate body 34 and (b) an internal gas phase pathway 68 which is also provided in the elongate body 34 but is different from the internal concentrated fluid pathway 42.

The internal concentrated fluid pathway 42 extends upwardly in the elongate body 34 from the upper end of the lower mechanical separation chamber 44*a* to a concentrated fluid discharge 45 provided by a head structure 50 attached at the upper end of the elongate body 34. The concentrated fluid discharge 45 delivers the concentrated fluid from each of separation chambers 44*a*, 44*b*, and 44*c* to the submersible pump 26.

Each of the rotary or vortex gas separator assemblies 55*a*, 55*b*, and 55*c* of the mechanical separation chambers 44*a*, 44*b*, and 44*c* preferably comprises: an inducer 52 (preferably a helical inducer) which is secured on and rotated by the rotating shaft 22; a guide vane element 54 which is secured on and rotated by the rotating shaft 22 and is positioned above the inducer 52; and a centrifugal rotor (or a vortex inducing impeller or other vortex inducing element) 56 which is secured on and rotated by the rotating shaft 22 and is positioned above the guide vane element 54. The centrifugal rotor or vortex inducing impeller 56 of each of the mechanical separation chambers 44*a*, 44*b*, and 44*c* will preferably be a centrifugal rotor comprising: (a) an elongate central hub 58 which is secured on the rotating shaft 22 and (b) a plurality of longitudinally extending paddle wheel-type blades 60 which project radially outward from the elongate central hub 58.

In each of the rotary or vortex gas separator assemblies 55*a*, 55*b*, and 55*c* used in the mechanical separation chambers 44*a*, 44*b*, and 44*c* of the inventive gas separator apparatus 20, the rotating helical or other inducer 52 at the lower end of the rotary or vortex separator assembly 55*a*, 55*b*, or 55*c* assists in delivering the production fluid intake for the mechanical separation chamber 44*a*, 44*b*, or 44*c* upwardly through the rotating guide vane element 54 of the assembly and through the centrifugal rotor element or vortex inducing impeller 56. In each case, the partially curved blades 62 of the rotating guide vane element 54 direct the flow of the fluid from the inducer 52 upwardly along a longitudinal path into the centrifugal rotor element or vortex inducing element 56. The rotating centrifugal rotor element or vortex inducing element 56 then operates to separate the fluid into a concentrated fluid phase which is forced radially outward and a gas phase which concentrates in the central portion of the mechanical separation chamber 44*a*. 44*b*, or 44*c* around the rotating shaft 22.

Flow divider elements 64*a*, 64*b*, and 64*c* are respectively provided in the upper ends of the mechanical separation chambers 44*a*, 44*b*, and 44*c* above the rotary or vortex gas separator assemblies. The divider elements 64*a*, 64*b*, and 64*c* divide the gas and concentrated fluid phases produced by the rotary or vortex gas separator assemblies 55*a*, 55*b*, and 55*c* in the mechanical separation chambers 44*a*, 44*b*, and 44*c* and direct the gas and concentrated fluid phases upwardly along separate flow paths.

In the lower mechanical separation chamber 44*a*, a cross-over element 66 is positioned in the elongate body 34 above the divider element 64*a* for (a) directing the concentrated fluid product produced by the rotary or vortex gas separator assembly 55*a* in the lower chamber 44*a* into the internal concentrated fluid pathway 42 within the elongate body 34 and (b) directing the gas phase product produced by the rotary or vortex gas separator assembly 55*a* in the lower chamber 44*a* along the internal gas phase pathway 68.

The internal gas phase pathway 68 runs upwardly through the elongate body assembly 34 from the lower mechanical separation chamber 44*a* to a gas phase discharge 70 which is preferably provided at a higher longitudinal location than the intake 100 of the higher mechanical separation chamber 44*c*. The gas phase discharge 70 is preferably positioned at least a sufficient distance above the uppermost fluid intake 100 to prevent the separated gas phase products produced by the inventive separator apparatus 20 from being recirculated back into the apparatus 20 via any of the parallel fluid intakes 40, 92 or 100 of the mechanical separation chambers 44*a*, 44*b*, or 44*c*. The gas phase discharge 70 preferably comprises one or more, preferably a plurality, of side discharge openings 72 formed in the head structure 50 at the upper end of the elongate body 34.

A cross-over structure 74 is also provided in the elongate body assembly 34 above the divider element 64*h* for the mid-level mechanical separation chamber 44*b*. The cross-over structure 74 comprises (a) flow channels 76 for directing the flow of the concentrated fluid product produced by the mid-level mechanical separation chamber 44*b* into the internal concentrated fluid pathway 42 within the body 34 and (b) gas phase flow channels 78 for directing the gas phase product produced by the mid-level mechanical separation chamber 44*b* into the internal gas phase pathway 68.

A further cross-over structure 80 is provided in the elongate body 34 above the divider element 64*c* for the higher mechanical separation chamber 44*c*. The cross-over structure 80 comprises (a) flow channels 82 for directing the flow of the concentrated fluid product produced by the higher mechanical separation chamber 44*c* either into the internal concentrated fluid pathway 42 or directly to the concentrated fluid discharge 45 at the upper end of the body 34 and (b) gas phase flow channels 84 for directing the gas phase product produced by the higher mechanical separation chamber 44*c* either directly to the gas discharge opening(s) 72 or into the internal gas phase pathway 68.

The mid-level fluid intake structure 46 used in the inventive gas separator apparatus 20 comprises (a) one or more bypass channels 86 for the internal concentrated fluid pathway 42 which divert the internal concentrated fluid pathway 42 around a centrally mounted bushing or bearing 88 for the rotating shaft 22 and (b) an intake channel 90 extending from each of the one or more mid-level side intake opening (s) 92. The intake channel(s) 90 direct the continuous flow of fresh production fluid 12 received from the well casing 6 by the mid-level intake opening(s) 92 into the lower end of the mid-level mechanical separation chamber 44*b*.

Similarly, the upper fluid intake structure 48 comprises (a) one or more bypass channels 94 for the internal concentrated fluid pathway 42 which divert the internal concentrated fluid pathway 42 around a centrally mounted bushing or bearing 96 for the rotating shaft 22 and (b) an intake channel 98 extending from each of the one or more upper side intake opening(s) 100. The intake channel(s) 98 direct the continuous flow of fresh production fluid 12 received from the well casing 6 by the upper intake opening(s) 100 into the lower end of the higher mechanical separation chamber 44*c*.

In the method of the present invention, the inventive ESP assembly 2 is positioned in the casing 6 of a well 8 such that fresh amounts of the production fluid 12 from the subterranean formation 10 are continuously, separately and simultaneously received through the fluid intake opening(s) 40 of the lower mechanical separation chamber 44*a*, the fluid intake opening(s) 92 of the mid-level mechanical separation chamber 44*b*, and the fluid intake opening(s) 100 of the higher mechanical separation chamber 44*c*. The rotary or vortex gas separator assemblies 55*a*, 55*h* and 55*c* provided in the lower, mid-level, and higher mechanical separation chambers 44*a*, 44*b*, and 44*c* then simultaneously operate in parallel such that: (i) the fresh production fluid received in the lower mechanical separation chamber 44*a* is separated in the chamber 44*a* to produce an amount of a gas phase product which is delivered to the internal gas phase pathway 68 and a concentrated product which is directed to the internal concentrated fluid pathway 42, (ii) the fresh production fluid received in the mid-level mechanical separation chamber 44*b* is separated in the chamber 44*b* to produce an amount of a gas phase product which is delivered to the internal gas phase pathway 68 and a concentrated product which is directed to the internal concentrated fluid pathway 42, and (iii) the fresh production fluid received in the higher mechanical separation chamber 44*c* is separated in the chamber 44*c* to produce an amount of a gas phase product which is delivered to the internal gas phase pathway 68 (or directly to the gas phase discharge 70) and a concentrated product which is directed to the internal concentrated fluid pathway 42 (or directly to the concentrated fluid discharge 45).

The separated gas phase products which are separately produced in the mechanical separation stages 44*a*, 44*b*, and 44*c* of the inventive gas separator apparatus 20 are all discharged from the gas phase discharge 70 of the inventive apparatus 20 into the annulus 105 formed outside of the ESP assembly 2 between the exterior of the ESP assembly 2 and the interior surface of the well casing 6. The discharged gas phase products then rise through the annulus 105 to the well head 32 for recovery.

The concentrated fluid products which are produced in the mechanical separation stages 44*a*, 44*b*, and 44*c* are delivered from the concentrated fluid discharge 45 of the inventive apparatus 20 to the intake of the submersible pump 26.

The submersible pump 26 then pumps the concentrated fluid products to the well head 32 via the tubing string or other conduit 4 for recovery.

It will be understood that, although the inventive parallel gas separator 20 is described herein as having a lower mechanical separation chamber 44*a*, and mid-level separation chamber 44*b*, and a higher mechanical separation chamber 44*c*, the inventive separator 20 can be used not only in a vertical orientation but can also be used in a horizontal or other non-vertical well. Therefore, as used herein and in the claims, it will be understood that: (a) the term "lower mechanical separation chamber" also refers to the chamber which is comparatively located at a greater insertion distance in a horizontal or other non-vertical well, (b) the term "higher mechanical separation chamber" also refers to the chamber which is comparatively located at a lesser insertion distance in a horizontal or other non-vertical well, and (c) the term "mid-level mechanical separation chamber" also refers to the chamber which is comparatively located between the "lower" chamber and the "higher" chamber in a horizontal or other non-vertical well.

Thus, the present invention is well adapted to carry out the objectives and attain the ends and advantages mentioned above as well as those inherent therein. While presently preferred embodiments have been described for purposes of this disclosure, numerous changes and modifications will be apparent to those in the art. Such changes and modifications are encompassed within the invention as defined by the claims.

What is claimed is:

1. An apparatus for use in a submersible pump assembly, in a casing of a well, for separating a gas phase from a well production fluid received in the casing from a subterranean formation, the apparatus comprising:

an elongate body having a longitudinal axis, a lower end, an upper end, and an exterior which extends from the lower end to the upper end;

a lower mechanical separation chamber in the elongate body, the lower mechanical separation chamber having one or more intake openings through the exterior of the elongate body, above the lower end of the elongate body, through which a first portion of the well production fluid in the casing of the well is received, and the lower mechanical separation chamber having a gas separator assembly therein which separates the first portion of the well production fluid to form a separated gas phase product and a concentrated fluid product;

a higher mechanical separation chamber in the elongate body which operates in parallel with the lower mechanical separation chamber, the higher mechanical separation chamber having one or more side intake openings through the exterior of the elongate body through which a second portion of the well production fluid in the casing of the well is received, the one or more side intake openings of the higher mechanical separation chamber being provided at a higher longitudinal location through the exterior of the elongate body than the one or more intake openings of the lower mechanical separation chamber, the second portion of the well production fluid being a different portion of the well production fluid in the casing of the well than the first portion of the well production fluid, and the higher mechanical separation chamber having a gas separator assembly therein which separates the second portion of the well production fluid to form a separated gas phase product and a concentrated fluid product;

the elongate body having an internal concentrated fluid pathway which extends upwardly through the elongate body from the lower mechanical separation chamber to a concentrated fluid discharge at the upper end of the elongate body and is configured to deliver the concentrated fluid product formed by the lower mechanical separation chamber to the concentrated fluid discharge, and the concentrated fluid product formed by the higher mechanical separation chamber also being discharged from the concentrated fluid discharge with the concentrated fluid product formed by the lower mechanical separation chamber;

a fluid intake structure for the higher mechanical separation chamber, included in the elongate body above the lower mechanical separation chamber, comprising one or more intake channels for the higher mechanical separation chamber which extend from the one or more side intake openings for the higher mechanical separation chamber, and the fluid intake structure further comprising one or more bypass channels of the internal concentrated fluid pathway, different from the one or more intake channels of the fluid intake structure, which divert the internal concentrated fluid pathway, and the concentrated fluid product therein formed by the lower mechanical separation chamber, toward the concentrated fluid discharge at the upper end of the elongate body;

an elongate rotating shaft which extends longitudinally through the elongate body;

the elongate body having a gas phase discharge which is provided at a higher longitudinal location than the one or more side intake openings of the higher mechanical separation chamber, and the elongate body also having an internal gas phase pathway which is different from the internal concentrated fluid pathway, wherein the internal gas phase pathway extends through the elongate body from the lower mechanical separation chamber to the gas phase discharge and is configured to deliver the separated gas phase product formed by the lower mechanical separation chamber to the gas phase discharge.

2. The apparatus of claim 1 wherein the separated gas phase product formed by the higher mechanical separation chamber is also discharged from the gas phase discharge.

3. The apparatus of claim 1 wherein the gas separator assembly of the lower mechanical separation chamber comprises:

an inducer which is rotated by the rotating shaft;

a guide vane element which is rotated by the rotating shaft and is positioned above the inducer; and a centrifugal rotor which is rotated, by the rotating shaft and is positioned above the guide vane element.

4. The apparatus of claim 3 wherein the gas separator assembly of the higher mechanical separation chamber comprises:

an inducer which is rotated by the rotating shaft;

a guide vane element which is rotated by the rotating shaft and is positioned above the inducer of the higher mechanical separation chamber, and a centrifugal rotor which is rotated by the rotating shaft and is positioned above the guide vane element of the higher mechanical separation chamber.

5. The apparatus of claim 1 further comprising:

a mid-level mechanical separation chamber in the elongate body which operates in parallel with the lower mechanical separation chamber and the higher mechanical separation chamber, the mid-level mechanical separation chamber having one or more side intake openings through the exterior of the elongate body through which a third portion of the well production fluid in the casing of the well is received, the one or more side intake openings for the mid-level mechanical separation chamber being provided at a higher longitudinal location through the exterior of the elongate body than the one or more intake openings of the lower mechanical separation chamber, the one or more side intake openings for the mid-level mechanical separation chamber being provided at a lower longitudinal location through the exterior of the elongate body than the one or more side intake openings of the higher mechanical separation chamber, the third portion of the well production fluid being a different portion of the well production fluid in the casing of the well than the first portion of the well production fluid and the second portion of the well production fluid, and the mid-level mechanical separation chamber having a gas separator assembly therein which separates the third portion of the well production fluid to form a separated gas phase product and a concentrated fluid product;

a fluid intake structure for the mid-level mechanical separation chamber, included in the elongate body above the lower mechanical separation chamber and below the fluid intake structure for the higher mechanical separation chamber, comprising one or more intake channels for the mid-level mechanical separation chamber which extend from the one or more side intake openings in the elongate body for the mid-level mechanical separation chamber, and the fluid intake structure for the mid-level mechanical separation chamber further comprising one or more bypass channels of the internal concentrated fluid pathway, different from the one or more intake channels of the fluid intake structure for the mid-level mechanical separation chamber, which divert the internal concentrated fluid pathway, and the concentrated fluid product therein formed by the lower mechanical separation chamber, toward the concentrated fluid discharge at the upper end of the elongate body;

one or more internal channels in the elongate body which extend from the mid-level mechanical separation chamber to the internal gas phase pathway to deliver the separated gas phase product formed by the mid-level mechanical separation chamber into the internal gas phase pathway for discharging the separated gas phase product produced by the mid-level mechanical separation chamber from the gas phase discharge; and one or more internal channels in the elongate body which extend from the mid-level mechanical separation chamber to the internal concentrated fluid pathway to deliver the concentrated fluid product formed by the mid-level mechanical separation chamber into the internal concentrated fluid pathway for discharging the concentrated fluid product formed by the mid-level mechanical separation chamber from the concentrated fluid discharge at the upper end of the elongate body with the concentrated fluid product formed by the lower mechanical separation chamber and the concentrated fluid product formed by the higher mechanical separation chamber.

6. The apparatus of claim 5 wherein the gas separator assembly of the mid-level mechanical separation chamber comprises:

an inducer which is rotated by the rotating shaft;

a guide vane element which is rotated by the rotating shaft and is positioned above the inducer of the mid-level mechanical separation chamber, and a centrifugal rotor which is rotated by the rotating shaft and is positioned above the guide vane element of the mid-level mechanical separation chamber.

7. An electric submersible pump assembly for delivery into a casing of a well having a well production fluid therein which is received in the casing from a subterranean formation, the electric submersible pump assembly comprising:

an electric submersible motor;

a gas separator apparatus positioned above the electric submersible motor; and a submersible pump positioned above the gas separator apparatus, wherein the gas separator apparatus comprises:

an elongate body having a longitudinal axis, a lower end, an upper end, and an exterior which extends from the lower end to the upper end;

a lower mechanical separation chamber in the elongate body, the lower mechanical separation chamber having one or more intake openings through the exterior of the elongate body, above the lower end of the elongate body, through which a first portion of the well production fluid in the casing of the well is received, and the lower mechanical separation chamber having a gas separator assembly therein which separates the first portion of the well production fluid to form a separated gas phase product and a concentrated fluid product;

a higher mechanical separation chamber in the elongate body which operates in parallel with the lower mechanical separation chamber, the higher mechanical separation chamber having one or more side intake openings through the exterior of the elongate body through which a second portion of the well production fluid in the casing of the well is received, the one or more side intake openings of the higher mechanical separation chamber being provided at a higher longitudinal location through the exterior of the elongate body than the one or more intake openings of the lower mechanical separation chamber, the second portion of the well production fluid being a different portion of the well production fluid in the casing of the well than the first portion of the well production fluid, and the higher mechanical separation chamber having a gas separator assembly therein which separates the second portion of the well production fluid to form a separated gas phase product and a concentrated fluid product;

the elongate body having an internal concentrated fluid pathway which extends upwardly through the elongate body from the lower mechanical separation chamber to a concentrated fluid discharge at the upper end of the elongate body and is configured to deliver the concentrated fluid product formed by the lower mechanical separation chamber to the concentrated fluid discharge, and the concentrated fluid product formed by the higher mechanical separation chamber also being discharged from the concentrated fluid discharge with the concentrated fluid product formed by the lower mechanical separation chamber;

a fluid intake structure for the higher mechanical separation chamber, included in the elongate body above the lower mechanical separation chamber, comprising one or more intake channels for the higher mechanical separation chamber which extend from the one or more side intake openings for the higher mechanical separation chamber, and the fluid intake structure further comprising one or more bypass channels of the internal concentrated fluid pathway, different from the one or more intake channels of the fluid intake structure, which divert the internal concentrated fluid pathway, and the concentrated fluid product therein formed by the lower mechanical separation chamber, toward the concentrated fluid discharge at the upper end of the elongate body;

an elongate rotating shaft which extends longitudinally through the elongate body;

the elongate body having a gas phase discharge which is provided at a higher longitudinal location than the one or more side intake openings of the higher mechanical separation chamber; and the elongate body also having an internal gas phase pathway which is different from the internal concentrated fluid pathway, wherein the internal gas phase pathway extends through the elongate body from the lower mechanical separation chamber to the gas phase discharge and is configured to deliver the separated gas phase product formed by the lower mechanical separation chamber to the gas phase discharge.

8. The electric submersible pump assembly of claim 7 further comprising a seal element between the electric submersible motor and the gas separator apparatus.

9. The electric submersible pump assembly of claim 7 wherein the separated gas phase product formed by the higher mechanical separation chamber of the gas separator apparatus is also discharged from the gas phase discharge.

10. The electric submersible pump assembly of claim 7 wherein the gas separator assembly of the lower mechanical separation chamber comprises:

an inducer which is rotated by the rotating shaft;

a guide vane element which is rotated by the rotating shaft and is positioned above the inducer; and a centrifugal rotor which is rotated by the rotating shaft and is positioned above the guide vane element.

11. The electric submersible pump assembly of claim 10 wherein the gas separator assembly of the higher mechanical separation chamber comprises:

an inducer which is rotated by the rotating shaft;

a guide vane element which is rotated by the rotating shaft and is positioned above the inducer of the higher mechanical separation chamber, and a centrifugal rotor which is rotated by the rotating shaft and is positioned above the guide vane element of the higher mechanical separation chamber.

12. The electric submersible pump assembly of claim 7 wherein the gas separator apparatus further comprises:

a mid-level mechanical separation chamber in the elongate body which operates in parallel with the lower mechanical separation chamber and the higher mechanical separation chamber, the mid-level mechanical separation chamber having one or more side intake openings through the exterior of the elongate body through which a third portion of the well production fluid in the casing of the well is received, the one or more side intake openings for the mid-level mechanical separation chamber being provided at a higher longitudinal location through the exterior of the elongate body than the one or more intake openings of the lower mechanical separation chamber, the one or more side intake opening for the mid-level mechanical separation chamber being provided at a lower longitudinal location through the exterior of the elongate body than the one or more side intake openings of the higher mechanical separation chamber, the third portion of the well production fluid being a different portion of the well production fluid in the casing of the well than the first portion of the well production fluid and the second portion of the well production fluid, and the mid-level mechanical separation chamber having a gas separator assembly therein which separates the third portion of the well production fluid to form a separated gas phase product and a concentrated fluid product;

a fluid intake structure for the mid-level mechanical separation chamber, included in the elongate body above the lower mechanical separation chamber and below the fluid intake structure for the higher mechanical separation chamber, comprising one or more intake channels for the mid-level mechanical separation chamber which extend from the one or more side intake openings for the mid-level mechanical separation chamber, and the fluid intake structure for the mid-level mechanical separation chamber further comprising one or more bypass channels of the internal concentrated fluid pathway, different from the one or more intake channels of the fluid intake structure for the mid-level mechanical separation chamber, which divert the internal concentrated fluid pathway, and the concentrated fluid product therein formed by the lower mechanical separation chamber, toward the concentrated fluid discharge at the upper end of the elongate body;

one or more internal channels in the elongate body which extend from the mid-level mechanical separation chamber to the internal gas phase pathway to deliver the separated gas phase product formed by the mid-level mechanical separation chamber into the internal gas phase pathway for discharging the separated gas phase product formed by the mid-level mechanical separation chamber from the gas phase discharge; and one or more internal channels in the elongate body which extend from the mid-level mechanical separation chamber to the internal concentrated fluid pathway to deliver the concentrated fluid product formed by the mid-level mechanical separation chamber into the internal concentrated fluid pathway for discharging the concentrated fluid product formed by the mid-level mechanical separation chamber from the concentrated fluid discharge at the upper end of the elongate body with the concentrated fluid product formed by the lower mechanical separation chamber and the concentrated fluid product formed by the higher mechanical separation chamber.

13. The electric submersible pump assembly of claim 12 wherein the gas separator assembly of the mid-level mechanical separation chamber comprises:

an inducer which is rotated by the rotating shaft;

a guide vane element which is rotated by the rotating shaft and is positioned above the inducer of the mid-level mechanical separation chamber; and a centrifugal rotor which is rotated by the rotating shaft and is positioned above the guide vane element of the mid-level mechanical separation chamber.

14. A method of recovering a fluid product from a well comprising the steps of:

a) positioning an electric submersible pump assembly in a casing of the well, wherein (i) the electric submersible pump assembly comprises an electric submersible motor, a gas separator apparatus above the electric submersible motor, and a submersible pump above the gas separator apparatus, (ii) the gas separator apparatus comprises an elongate body having a longitudinal axis, a lower end, an upper end, and an exterior which extends from the lower end to the upper end, (iii) an annulus is formed between the exterior of the elongate body of the gas separator apparatus and an interior wall of the casing, and (iv) a well production fluid is received in the annulus from a subterranean formation;

b) receiving a first portion of the well production fluid which is in the annulus through one or more intake openings of a lower mechanical separation chamber within the gas separator apparatus and separating the first portion of the well production fluid to form a gas phase product and a concentrated product using a gas separator assembly in the lower mechanical separation chamber, the one or more intake openings of the lower mechanical separation chamber being provided through the exterior of the elongate body above the lower end of the elongate body;

c) delivering the gas phase product separated in step (b) through an internal gas phase pathway in the elongate body of the gas separator apparatus to a gas discharge of the elongate body;

d) delivering the concentrated product formed in step (b) through an internal concentrated fluid pathway in the elongate body, different from the internal gas phase pathway, to a concentrated fluid discharge at the upper end of the elongate body of the gas separator apparatus;

e) simulataneously with step (b) receiving a second portion of the well production fluid which is in the annulus through one or more side intake openings of a higher mechanical separation chamber within the gas separator apparatus, the higher mechanical separation chamber operating in parallel with the lower mechanical separation chamber, and separating the second portion of the well production fluid to form a gas phase product and a concentrated product using a gas separator assembly in the higher mechanical separation chamber, the one or more side intake openings of the higher mechanical separation chamber being provided through the exterior of the elongate body at a higher longitudinal location than the one or more intake openings of the lower mechanical separation chamber, and the second portion of the well production fluid being delivered to the higher mechanical separation chamber by a fluid intake structure for the higher mechanical separation chamber, the fluid intake structure being included in the elongate body above the lower mechanical separation chamber and comprising one or more intake channels for the higher mechanical separation chamber which extend from the one or more side intake openings for the higher mechanical separation chamber, and the fluid intake structure further comprising one or more bypass channels of the internal concentrated fluid pathway, different from the one or more intake channels of the fluid intake structure, which divert the internal concentrated fluid pathway, and the concentrated product therein formed by the lower mechanical separation chamber, toward the concentrated fluid discharge at the upper end of the elongate body of the gas separator apparatus;

f) delivering the gas phase product separated in step (e) to the gas discharge of the gas separator apparatus, wherein the gas discharge of the gas separator apparatus is provided at a higher longitudinal location than the one or more side intake openings of the higher mechanical separation chamber; and g) discharging the concentrated product formed in step (e) from the concentrated fluid discharge at the upper end of the gas separator apparatus in combination with the concentrated product formed in step (b).

15. The method of claim 14 further comprising the steps of:

delivering the concentrated products formed in steps (b) and (e) to the submersible pump from the concentrated fluid discharge and then recovering the concentrated products by pumping the concentrated products through a tubing string using the submersible pump.

16. The method of claim 15 further comprising the steps of:

simultaneously with steps (b) and (e), receiving a third portion of the well production fluid which is in the annulus through one or more side intake openings of a mid-level mechanical separation chamber within the gas separator apparatus, the mid-level mechanical separation chamber operating in parallel with the lower mechanical separation chamber and the higher mechanical separation chamber, and separating the third portion of the well production fluid to form a gas phase product and a concentrated product using a gas separator assembly in the mid-level mechanical separation chamber, the one or more side intake openings of the mid-level separation chamber being provided through the exterior of the elongate body at a higher longitudinal location than the one or more intake openings of the lower mechanical separation chamber, the one or more side intake openings of the mid-level separation chamber being provided at a lower longitudinal location through the exterior of the elongate body than the one or more side intake openings of the higher mechanical separation chamber, and the third portion of the well production fluid being delivered to the mid-level mechanical separation chamber by a fluid intake structure for the mid-level mechanical separation chamber, the fluid intake structure for the mid-level mechanical separation chamber being included in the elongate body above the lower mechanical separation chamber and below the fluid intake structure for the higher mechanical separation chamber, and the fluid intake structure for the mid-level mechanical separation chamber comprising one or more intake channels for the mid-level mechanical separation chamber which extend from the one or more side intake openings for the mid-level mechanical separation chamber, and the fluid intake structure for the mid-level mechanical separation chamber further comprising one or more bypass channels of the internal concentrated fluid pathway, different from the one or more intake channels of the fluid intake structure for the mid-level mechanical separation chamber, which divert the internal concentrated fluid pathway, and the concentrated product therein formed by the lower mechanical separation chamber, toward the concentrated fluid discharge at the upper end of the elongate body of the gas separator apparatus;

delivering the gas phase product separated in the mid-level mechanical separation chamber to the gas discharge of the gas separator apparatus via the internal gas phase pathway; and delivering the concentrated product formed in the mid-level mechanical separation chamber to the concentrated fluid discharge of the gas separator apparatus via the internal concentrated fluid pathway and discharging the concentrated product formed in the mid-level mechanical separation chamber from the concentrated fluid discharge in combination with the concentrated product formed in step (b) and the concentrated product formed in step (e).

17. The method of claim 16 wherein the method further comprises the steps of:

delivering the concentrated product formed in the mid-level separation chamber of the gas separator apparatus, in combination with the concentrated product formed in step (b) and the concentrated product formed in step (e), to the submersible pump from the concentrated fluid discharge and then recovering the concentrated product formed in the mid-level separation chamber, the concentrated product formed in step (b), and the concentrated product formed in step (e) from the well by pumping the concentrated product formed in the mid-level separation chamber through the tubing string along with the concentrated products produced in steps (b) and (e) using the submersible pump.

18. The method of claim 14 wherein the electric submersible pump assembly further comprises a seal element between the electric submersible motor and the gas separator apparatus.

* * * * *